US005131871A

United States Patent [19]

Banakis et al.

[11] Patent Number: 5,131,871

[45] Date of Patent: Jul. 21, 1992

[54] UNIVERSAL CONTACT PIN ELECTRICAL CONNECTOR

[75] Inventors: Emanuel G. Banakis; Glenn A. Landgraf, both of Naperville; Michael J. Penley, Crystal Lake; Robert M. Petrie, Glen Ellyn, all of Ill.

[73] Assignee: Molex Incorporated, Lisle, Ill.

[21] Appl. No.: 685,949

[22] Filed: Apr. 16, 1991

[51] Int. Cl.[5] ..... H01R 13/42

[52] U.S. Cl. ..... 439/751; 439/444; 439/873

[58] Field of Search ..... 439/733, 741, 751, 870, 439/873, 387, 433, 434, 444

[56] References Cited

U.S. PATENT DOCUMENTS 3,399,371 8/1968 Inacker ..... 439/741
3,670,294 6/1972 Johnson et al. .
4,553,801 11/1985 Zajeski ..... 439/751
4,575,176 3/1986 Castello et al. ..... 439/751
4,697,864 10/1987 Hayes et al. ..... 439/444
4,932,902 6/1990 Crane, Jr. .

FOREIGN PATENT DOCUMENTS 3203676 8/1983 Fed. Rep. of Germany ..... 439/751

*Primary Examiner*—David L. Pirlot
*Attorney, Agent, or Firm*—A. A. Tirva

[57] ABSTRACT

An improvement is provided in an electrical connector system which includes a connector block of insulating material having a plurality of pin receiving openings for positioning a plurality of terminal pins therein by an interference fit. At least some of the openings each are generally rectangularly shaped and include inwardly directed pin engaging projections located in diagonally opposite quadrants of the rectangular opening. The invention contemplates that the connector block may have a series of the openings in a closely spaced row. The diagonally opposite quadrants in which the projections are disposed are at the same respective locations in each opening along the row.

5 Claims, 1 Drawing Sheet

UNIVERSAL CONTACT PIN ELECTRICAL CONNECTOR

FIELD OF THE INVENTION

This invention generally relates to the art of electrical connectors and, particularly, to electrical connectors which employ contact or terminal pins.

BACKGROUND OF THE INVENTION

Many types of electrical connector systems are used for interconnecting electrical and electronic components by inserting an electrical pin-type terminal into an electrical socket thereby electrically coupling two system locations. Usually, connectors used in such systems include some form of connector block of insulating material having a plurality of connector pins of electrically conductive material inserted through a plurality of pin receiving openings in the block. The openings may be in a given array or a designated pattern, such as one or more rows. The connector block usually is unitarily molded of plastic material or the like and may comprise the header or "wafer" for locating the terminal pins in proper positions for mating or connecting to a complementary electrical or electronic component.

Still further, attempts have been made to design connector blocks used in such systems so that they are somewhat universal for receiving different configurations of terminal pins. For instance, square pin receiving openings can receive both a square terminal pin and a round terminal pin, with the sides of the square pin and the diameter of the round pin being substantially the same dimensions as the cross-dimensions of the square openings, thereby providing an interference fit with both pin configurations. One of the problems with such systems, particularly in using square or rectangular terminal pins in corresponding square or rectangular openings is that the sides of the pins tend to scrape plastic particles from the sides of the connector block openings. This can happen during initial assembly or particularly during repeated repairs of the connector. The scraped particles or "shavings" accumulate on the pin heads and interfere with the interconnections between the pins and mating electrical terminals.

One approach to solving the problem of particle accumulator is to design the square or rectangular pins in what is commonly termed "starred" configurations. A starred terminal pin is fabricated by disrupting the metal corners of square or rectangular pins so that the corners project outwardly from the sides of the pins. The connector blocks are provided with square or rectangular openings sized such that the starred corners of the pins are disposed in the corners of the openings, with the sides of the pins spaced from the sides of the openings and thereby eliminate some of the scraping problems of the pins against the plastic material surrounding the openings. However, this approach detracts from the desirability of providing a universal system for accommodating a variety of terminal pins, because either the opening has to be enlarged or the body of the rectangular pins must be made smaller.

Other problems are encountered with connector systems utilizing connector blocks having pin receiving openings, particularly in multi-terminal connectors. Specifically, such connectors often include a series of terminal pins in a row or a plurality of rows. In miniature connectors, the pins are very closely spaced and the openings are separated by relatively thin wall portions of the connector block. It is not uncommon to encounter square pins on the order of 0.025 inch or round pins having 0.025 diameters. Because the pins are inserted into the openings with an interference fit, breaking or cracking of the walls between the openings in such miniature high-density connectors is a continuing problem. This can be understood when it is considered that it would not be uncommon to have as many as forty pins in a single row. The forces created by the interference fits of the pins in their respective openings multiply along the length of the row block, creating stresses which tend to crack the block particularly in the area of the walls or partitions between the pin receiving openings.

This invention is directed to solving all of the above problems by providing a connector block designed with a unique configuration for the pin receiving openings which can accommodate square, round or starred terminal pins and which significantly reduces stresses in the connector block.

SUMMARY OF THE INVENTION

An object, therefore, of the invention is to provide a new and improved electrical connector system of the type which utilizes connector blocks of insulating material having a plurality of pin receiving openings for positioning a plurality of terminal pins therein by an interference fit.

Another object of the invention is to provide a unique configuration of a pin receiving opening in a connector block of an electrical connector system of the character described.

Generally, the invention contemplates providing a terminal pin receiving opening of a generally rectangular shape and which includes inwardly directed pin engaging projections located in diagonally opposite quadrants of the rectangular opening.

More specifically, the opening may be defined by an "X" axis through the mid-point of two opposite sides of the rectangular opening, and a "Y" axis through the midpoint of the other two opposite sides of the rectangular opening. The axes, in turn, define rectangular quadrants of the opening. The inwardly directed pin engaging projections are located in diagonally opposite quadrants of the rectangular opening, with the other two quadrants being free of any projections.

As disclosed herein, the opening is generally square to accommodate either a square, a round or a starred terminal pin of common cross-dimensions at said axes.

In the preferred embodiment of the invention, the projections each have an inwardly facing pin engaging surface which is generally flat and parallel to the side of the rectangular opening from which the projection projects One of the projections is located on each side of the rectangular opening in the diagonally opposite quadrants. Each projection is offset from but immediately adjacent a mid-point of the respective side wall of the opening from which the projection projects, i.e. immediately adjacent the respective axis defined above.

It also is contemplated that a connector block be provided with a series of the openings in a closely spaced row, with the opposite diagonal quadrants within which the projections are disposed being at the same respective locations in each opening of the series thereof.

By configuring the pin receiving openings as described above, each opening can accommodate either a square pin or a round pin of similar cross-dimensions as well as a starred pin having a body of the same dimensions as the square pin. The inwardly directed projections create spacings in the corners of the opening to accommodate the enlarged corners of the starred pin. The spacings between the projections also provide open areas into which plastic particles or shavings of the material of the connector block can migrate rather than accumulating on the terminal pin heads. By positioning the projections in diagonally opposite quadrants of each opening, in a connector block which has a series of openings in a row, the forces created by the interference fits of the pins in the openings do not multiply along the length of the row and thereby greatly reduces, if not eliminates, cracking of the connector block, particularly cracking of the walls between the series of openings.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
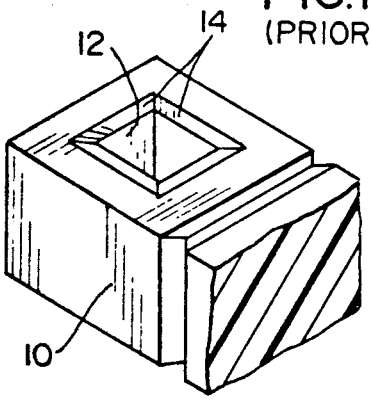
FIG.1 (PRIOR ART)
FIG. 1 is a fragmented perspective view of a connector block having a rectangular opening according to the prior art.

Referring to the drawings in greater detail, and first to FIG. 1, a connector block 10 is shown with a square pin receiving opening 12 of conventional configuration, extending through the connector block. The opening can receive either a square terminal pin with an interference fit in the opening, or a round terminal pin having a diameter equal to the cross-dimensions of the square opening.

As stated above, one of the problems with the prior art as exemplified in FIG. 1, is that a square pin, because of its interference fit, will scrape the sides of opening 12 and cause plastic particles or shavings from the connector block material to accumulated on the pin head and cause problems in providing a good electrical connection with a mating terminal, such as a female terminal. One approach to the problem has been to chamfer the leading edges of the opening, as at 14, and to chamfer the pin head to at least reduce chipping of the corners of the opening. This approach has not proven satisfactory because the sides of the pin still scrape the sides of the opening.

As stated above, another approach to solving the particle accumulation problem has been to provide starred terminal pins, as described above, whereby the enlarged corners of the pins are positioned in the corners of the square opening, spacing the sides of the pins from the opening. However, this approach obviates the desirability of providing a universal connector which could accommodate the various configurations of pins described.

Figure 2:
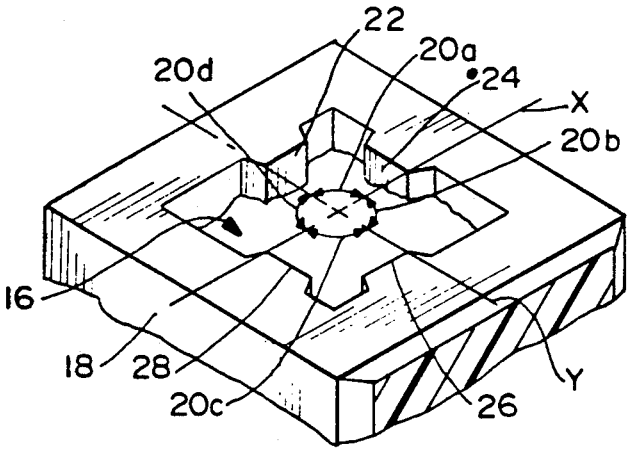
FIG. 2 is a fragmented perspective view of a connector block having a pin receiving opening according to the invention.

FIG. 2 shows an opening, generally designated 16, through a connector block 18 and incorporating the concepts of the invention. The connector block is unitarily molded of insulating material, such as plastic or the like. More particularly, opening 16 can be described as having an "X" axis through a mid-point of two opposite sides of the opening, and a perpendicular "Y" axis through the mid-point of the other two opposite sides of the opening. Therefore, the axes divide the opening into four quadrants represented by double-headed arrows 20*a*, 20*b*, 20*c* and 20*d*.

The invention contemplates that opening 16 be provided with a plurality of inwardly directed pin engaging projections 22, 24, 26 and 28. Preferably, the projections have generally flat inwardly facing surfaces parallel to the respective sides of the opening from which the projections project, as shown.

Generally, projections 22–26 are located in diagonally opposite quadrants of the opening, with one of the projections located on each side of the opening in the respective diagonally opposite quadrant.

More particularly, referring to the enumerated projections and quadrants, projections 22 and 24 are located in quadrant 20*a*; projections 26 and 28 are located in quadrant 20*c*; and quadrants 20*b* and 20*d* are void of projections.

Still further, in the preferred embodiment of the invention, the projections generally are offset from but immediately adjacent a mid-point of the respective side wall of the opening from which the projection projects. Referring specifically to the numerically referenced projections, projection 22 in quadrant 20*a* is located offset from but immediately adjacent axis "X". Projection 24 in quadrant 20*a* is offset from but immediately adjacent axis "Y". Projection 26 is offset from but immediately adjacent axis "X". Projection 28 in quadrant 20*c* is offset from but immediately adjacent axis "Y". It should be noted that a corner of each projection is on the adjacent axis.

Figure 3:
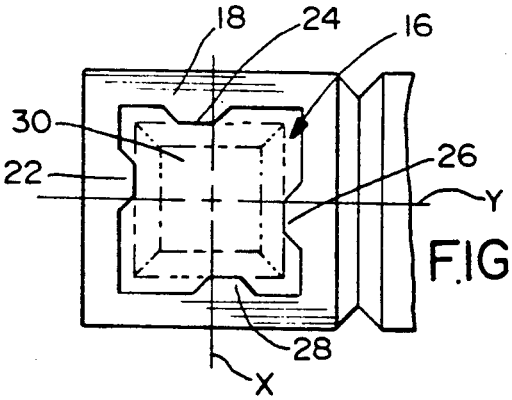
FIG. 3 is a top plan view showing a square pin received in the opening illustrated in FIG. 1.
Figure 5:
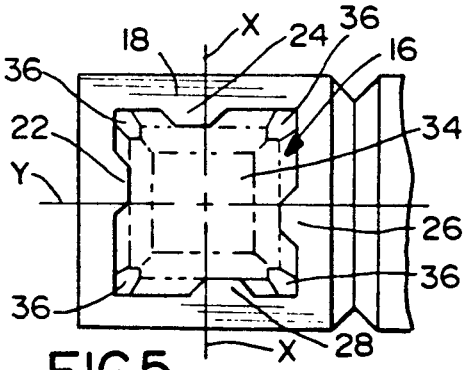
FIG. 5 is a view similar to that of FIGS. 3 and 4, with a starred pin received in the opening.
Figure 4:
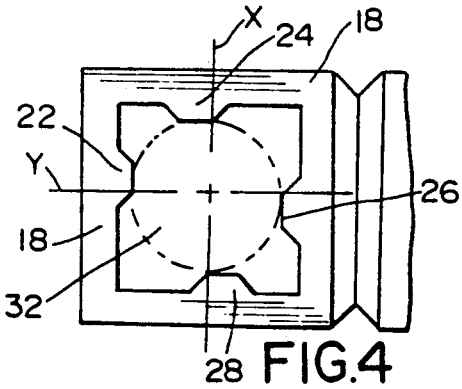
FIG. 4 is a view similar to that of FIG. 3, with a round pin received in the opening.

FIGS. 3–5 illustrate how the opening 16 described with specificity in relation to FIG. 2, will accommodate either a square, round or starred terminal pin. More particularly, FIG. 3 shows a square pin 30 in opening 16, with the sides of the square pin engaging all of the flat surfaces of projections 22–28. It can be seen that voids or open spaces are provided in the opening about the periphery of the square pin between the projections. These open spaces allow particles or shavings from connector block 18 to migrate and fall from the connector rather than accumulating on the pin head.

FIG. 4 shows a round terminal pin 32 inserted through opening 16, with the circular periphery of the pin engaging the corners of projections 22–28 immediately adjacent axes "X" and "Y". Again, it can be seen that voids or spaces are provided between the round terminal pin and the sides of the openings at the corners of the openings.

FIG. 5 shows a starred terminal pin 34 which has enlarged corners 36 formed by interrupting the corners of a square pin to enlarge its corners. However, it should be noted that the body of pin 34 is dimensioned the same as square pin 30 (FIG. 3). In addition, opening 16 remains identical in size and configuration. In other words, as explained above, neither the opening has to be enlarged nor the basic body of the pin has to be made smaller, in order to accommodate the starred pin as well as a square or round pin. It can be seen in FIG. 5 that the sides of the body of starred pin 34 engage projections 22–28 the same as square pin 30 in FIG. 3.

Figure 6:
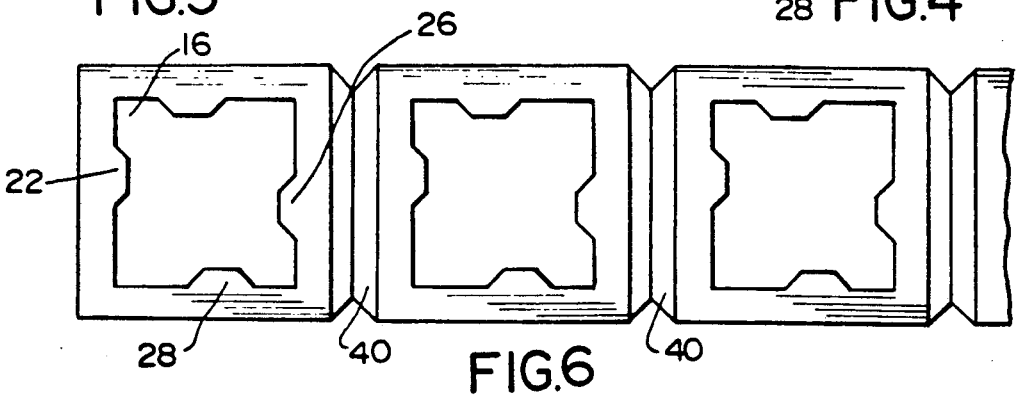
FIG. 6 is a top plan view of an elongated connector block having a series of pin receiving openings, according to the invention, in a closely spaced row along the length of the connector block

FIG. 6 shows a connector block 18 which has a series of openings 16, according to the invention, in a closely spaced row. As stated above, the invention is readily applicable for high-density miniaturized connector systems. For instance, the cross-dimensions of square pin 30, the diameter of round pin 32 or the dimensions of the body of starred pin 34 may be on the order of 0.025 inch with relatively close spacing between the pins in a row thereof as depicted in FIG. 6. Consequently, walls or partitions 40 (FIG. 6) between adjacent openings 16 are relatively thin and prone to breaking or cracking. With connector systems of the prior art which utilize terminal pins interference fit in openings in a connector block, as described herein, it has been found that the connector block actually "grows" in length then all of the terminal pins are inserted in their respective openings. This has been proven by measuring the length of the connector block prior to inserting the terminal pins and again measuring the length of the connector block after the terminal pins have been inserted. Consequently, it can be understood that considerable stresses are created on the connector block in response to the interference fit between the pins and the openings, and these stresses normally are concentrated in the walls or partitions between the openings. As a result, the walls are prone to break or crack. This phenomenon is a result of the forces created by the interference fits of the terminals multiplying or accumulating along the length of the connector block. In other words, forces created in one opening are directly opposite forces created in the adjacent opening and a considerable lengthwise multiplying affect is created generally along a straight line through the mid-points of the dividing walls between the openings.

With an understanding of the forces involved in connector block 18 described immediately above in relation to FIG. 6, the invention contemplates that the projections in each opening 16, as described in relation to FIGS. 2–5, be in diagonally opposite quadrants at the same respective locations in each opening. This can be seen in FIG. 6. Consequently, the projections in one opening are located in a quadrant opposite a quadrant in the adjacent opening which is void of projections. Therefore, the multiplying effect of forces lengthwise of the row of openings is practically negligible. In addition, it can be seen that all of the projections on the adjacent sides of adjacent openings are offset from the mid-point of the dividing walls or partitions. This further reduces the stress problems by offsetting the forces from the mid-point of the dividing walls where the walls are most prone to break or crack.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector system which includes a connector block of insulating material having a pin receiving opening for positioning a terminal pin therein by a close fit therewith, the improvement comprising said opening being generally rectangularly shaped defining an "X" axis through the mid-point of two opposite sides of the rectangular opening and a "Y" axis through the mid-point of the other two opposite sides of the rectangular opening, the axes in turn defining rectangular quadrants of the opening, the axes in turn defining rectangular quadrants of the opening, and including inwardly directed pin engaging projections located in diagonally opposite quadrants of the rectangular opening wherein one of said projections is located on each side of the rectangular opening in said diagonally opposite quadrants.

2. The improvement of claim 1 wherein said projections each have an inwardly facing pin engaging surface generally parallel to the side of the rectangular opening from which the projection projects.

3. The improvement of claim 1 wherein each projection is offset from but immediately adjacent the respective axis which passes through the respective side of the opening from which the projection projects.

4. The improvement of claim 1 wherein said projections each have an inwardly facing pin engaging surface generally parallel to the side of the rectangular opening from which the projection projects.

5. The improvement of claim 1 wherein the connector block has a series of said openings in a closely spaced row, with said diagonally opposite quadrants being at the same respective locations in each opening along the row.

* * * * *